United States Patent [19]

Bostedt

[11] 4,353,407

[45] Oct. 12, 1982

[54] CONTINUOUS CASTING MACHINE

[76] Inventor: Jan Bostedt, Iduns väg 17, S-723 55 Västerås, Sweden

[21] Appl. No.: 68,428

[22] Filed: Aug. 21, 1979

[30] Foreign Application Priority Data

Aug. 22, 1978 [SE] Sweden ..... 7808830

[51] Int. Cl.[3] ..... B22D 11/10; B22D 27/02

[52] U.S. Cl. ..... 164/468; 164/486

[58] Field of Search ..... 164/49, 147, 250, 251, 164/444

[56] References Cited

U.S. PATENT DOCUMENTS 4,030,534 6/1977 Ito et al. ..... 164/147
4,129,175 12/1978 Gladwin ..... 164/444
4,139,047 2/1979 Parrish ..... 164/250 X

FOREIGN PATENT DOCUMENTS 229759 2/1969 U.S.S.R. ..... 164/49
558752 7/1977 U.S.S.R. ..... 164/444

*Primary Examiner*—Gus T. Hampilos

[57] ABSTRACT

Continuous metal casting apparatus has an electromagnetic stirrer for molten metal remaining in the cast strand leaving the mold, the stirrer being housed in a water-cooled hollow walled shell having a front wall facing the strand and provided with spray nozzles in an array patterned depending on whether the strand is straight or curved. This wall has been an integral part of the shell, the shell's water supplying the nozzles. To permit the same stirrer and shell to be used for both straight and curved strands, a face plate is made as a separate part removably fastened to the front wall, permitting other plates to be provided for interchange, the plates respectively having arrays of nozzles differently contoured to accommodate straight or curved strands. A frame fixed to the front wall and to which the face plate is removably fastened, forms a manifold space behind the plate and open to the front wall's openings in which the nozzles were formerly positioned, the face plate nozzles being thereby supplied with the water cooling the shell.

1 Claim, 4 Drawing Figures

CONTINUOUS CASTING MACHINE

BACKGROUND OF THE INVENTION

A continuous metal casting apparatus basically comprises a continuous casting mold, means for guiding a cast strand downwardly away from the mold with the strand either straight or curved and at least one electromagnetic stirrer positioned to stir metal remaining molten in the strand prior to complete solidification of the strand throughout. To increase the rate of solidification, the strand is sprayed by cooling water sprays.

The electromagnetic stirrer is exposed to the strand's heat radiation and can interfere with the water spraying of the strand.

It has been proposed to encase the stirrer by a water-cooled hollow-walled shell having a front wall facing the strand and provided with spray discharge nozzles fed with the cooling water in the shell which is itself supplied with pressurized cooling water. This front wall is spaced somewhat from the strand.

The assembly of the stirrer and shell comprise a unit which is expensive to make to order. The manufacturer cannot resort to quantity production because of the uncertainty concerning the installation for which the unit will be used and which in different instances may involve straight strand guiding or curved strand guiding possibly with differing radii of curvature.

The above represents a problem which the present invention is intended to solve.

SUMMARY OF THE INVENTION

This solution is provided by a flat face plate provided with the array of nozzles and removably fastened and separable from the shell's front wall, via a flat frame forming a flat manifold space between the back of the face plate and the front wall and connecting with the shell's interior for a water supply.

Only this face plate need be made to order and its manufacture is relatively inexpensive. Quantity production of the shell-encased electromagnetic stirrers is made possible with the consequent reduction of manufacturing costs.

Stirrers that have been in service and designed for one continuous casting installation can be converted by application of a new face plate for use in another installation where the strand travel contour is different. In each instance only the face plate need be designed with the nozzle array pattern required.

The face plate provides at least some protection for the stirrer shell in the event of a strand skin break-out. Replacement of the face plate is relatively inexpensive.

The invention is disclosed in more detail by the accompanying drawings and the following description:

DESCRIPTION OF THE DRAWINGS

The drawings are entirely schematic but serve adequately to disclose the details of this invention, the various figures being as follows:

FIG. 1 is a side elevation view and is intended only to show the locations of the various parts of a continuous casting apparatus of the type referred to;

DETAILED DESCRIPTION OF THE INVENTION

Figure 1:
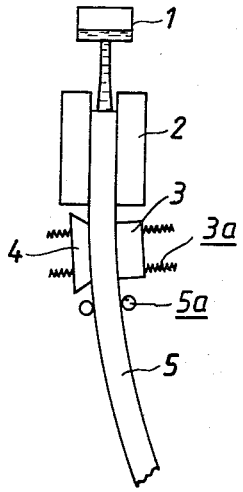

FIG. 1 shows the tun dish 1 in which the molten steel is cast and which feeds the continuous casting mold 2, below which an electromagnetic stirrer 3 is roughly indicated, opposite to which is a water-cooled pressure plate 4, the strand 5 being guided by a roller series of which one pair 5*a* is shown.

An electromagnetic stirrer protected by a water-cooled shell can have the front wall of the shell spring pressed directly against the strand as illustrated by FIG. 1, but this subjects the front wall to direct frictional contact with the strand and interferes with the spray cooling of the strand.

It has been proposed that the electromagnetic stirrer be held at a position spaced from the strand, by using appropriately positioned abutments, with the front wall of the water-cooled shell provided with spray nozzles fed via the shell's hollow walls to which pressurized cooling water is supplied.

Figure 2:
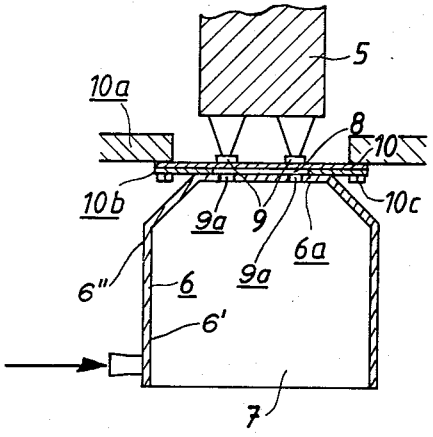
FIG. 2 is a cross section view showing the shell and its removable and replaceable face plate carrying the nozzles.

FIG. 2 shows what can be a conventional hollow-walled shell 6 formed by an inner wall 6' and outer wall 6'', and within which the usual but not shown coils and pole pieces of the electromagnetic stirrer 7 are positioned to form a water-cooled unit, the feed of pressurized water being indicated by the arrow. The shell is spring biased towards the strand 5, as indicated at 3*a* in FIG. 1, but with its front wall 6*a* spaced somewhat and free from the strand 5. For this, abutments are indicated at 10*a*.

In accordance with the present invention, a flat manifold space 8 is formed on the front wall 6*a* of the shell, in front of its part of the outer wall 6'', for receiving the pressurized water from the shell and feeding the nozzles 9 mounted in this case by a flat plate 10 which is separate from the shell. This space 8 can be formed by a flat plate frame 10*b* welded to the front wall of the shell and in communication with the interior of the hollow-walled shell fed with the pressurized water. The communication with the space 8 may be done in many ways, possibly via already formed nozzle openings 9*a* in the outer wall 6'' of the front wall of the shell. The two parts 10 and 10*b* can be releasably fastened together as by screw fastenings 10*c*.

The flat frame 10*b* can be welded to and a part of any stirrer of an inventory of stirrers, with only the face plate a custom-made item, or the face plate can be easily welded to the shell of a stirrer that has previously been in service.

Figure 3:
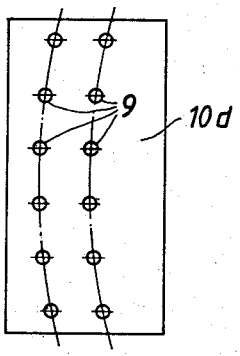
FIG. 3 is a front view of one face plate having an array of nozzles patterned to accommodate a curved strand.
Figure 4:
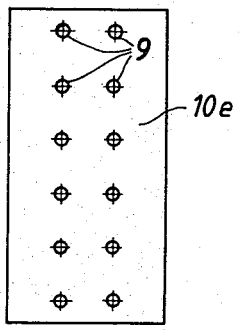
FIG. 4 is a front view of another of the face plates, in this case with the nozzle's pattern for use with a straight strand.

When in operation, the pressurized cooling water fed to the interior of the hollow-walled shell 6 can feed to the shell's front wall as usual and out through what can be specially designed nozzle openings, into the space 8 for ejection against the strand 5 by the nozzles 9. If the strand is curved, the face plate 10*d* of FIG. 3 is used, and if straight, the plate 10*e* of FIG. 4 is used.

The parts which might cause magnetic interference, are of course made of non-magnetic metal.

What is claimed is:

1. A continuous metal casting machine comprising a continuous casting mold adapted to cast a downwardly traveling hot cast strand containing molten metal, means for guiding said strand along a fixed traveling path, an electromagnetic stirrer positioned below said mold beside said path on the outside of said strand so as to stir said molten metal and so as to be exposed to heat from the strand, said stirrer being protected from said head by being encased in a shell including a hollow front wall spaced from and facing said strand, and means associated with said shell for feeding pressurized cooling water to an internal cavity defined by walls of said hollow front wall, an outer wall of said hollow front wall to defining openings pointing towards said strand so as to permit said water to discharge towards said path of travel of the strand; wherein the improvement comprises a flat frame fixed to the outer wall of said hollow front wall so as to surround said openings, a face plate removably fastened to an outer surface of said frame and having nozzle openings defined therethrough and pointing towards said strand, said face plate being spaced from said front wall by said frame so as to form a manifold adapted to receive said water discharged from said openings and distribute the water to said nozzle openings so the latter discharge the water towards said strand, and releasable fastening means associated with said frame and face plate for fastening said face plate to said frame so as to permit removal of the face plate, the nozzle openings in said face plate forming a pattern conforming to the shape of said strand, removal of said face plate permitting its replacement by a corresponding face plate having nozzle openings forming a different pattern when the strand has a different shape.

* * * * *